United States Patent [19]

de Leaumont

[11] 3,948,483

[45] Apr. 6, 1976

[54] SLIDING SHUTTERING RAISING DEVICE FOR THE CONTINUOUS PRODUCTION OF PARTITIONS AND SHUTTERING FITTED WITH THIS DEVICE

[75] Inventor: Jean Marie Charles Roger Gonzagues de Leaumont, Reims, France

[73] Assignee: Le Ciment Arme Demay Freres, Reims, France

[22] Filed: May 31, 1974

[21] Appl. No.: 474,882

[52] U.S. Cl. ..... 254/106; 249/20; 425/63

[51] Int. Cl.[2] ..... B66F 1/00

[58] Field of Search ..... 425/63, 64, 65; 249/20, 249/21, 22; 254/105, 106

[56] References Cited

UNITED STATES PATENTS

| | | | |
|---|---|---|---|
| 1,397,241 | 11/1921 | Convert | 425/65 |
| 2,673,066 | 3/1954 | Norman | 254/106 |
| 2,756,019 | 7/1956 | Heidenstam et al. | 254/105 |
| 3,325,146 | 6/1967 | Ahl | 425/63 |
| 3,347,522 | 10/1967 | Reinmann | 254/105 |
| 3,685,801 | 8/1972 | Ahlgren et al. | 254/105 |

FOREIGN PATENTS OR APPLICATIONS

| | | | |
|---|---|---|---|
| 557,075 | 3/1954 | Canada | 254/106 |
| 217,200 | 9/1961 | Austria | 425/63 |
| 638,918 | 3/1962 | Canada | 254/105 |

*Primary Examiner*—Francis S. Husar
*Assistant Examiner*—Carl Rowold
*Attorney, Agent, or Firm*—McNenny, Farrington, Pearne & Gordon

[57] ABSTRACT

The invention relates to a device for raising a sliding shuttering designed to be used for the continuous production of silos, water towers, etc.

The device consists of two cases, coaxial with a slide bar, separated from one another by a jack also coaxial of which each of the two parts in respectively integral with one of the cases, each case comprising locking jaws in its interior which, alternating from one case to the other, engage with a slide bar, the locked case serving as a support point for the case in movement and reciprocally, the pressure of the compressed high-pressure fluid of the jack for raising the case joined to the frame, supporting the shuttering, which device is characterised in that the means for raising the other case is provided by a low pressure fluid which acts when the high-pressure fluid is decompressed, which enables an efficient device to be obtained and avoid even a slight backward movement of the shuttering.

5 Claims, 5 Drawing Figures

SLIDING SHUTTERING RAISING DEVICE FOR THE CONTINUOUS PRODUCTION OF PARTITIONS AND SHUTTERING FITTED WITH THIS DEVICE

The invention relates to a device for raising a sliding shuttering designed to be used for the continuous production of silos, water towers, etc., this device comprising locking members to prevent the unintended backward movement of the shuttering, in particular when the jack for raising said shuttering is being set.

The continuous casting of concrete for the construction of silos, water towers, reservoirs of all kinds, etc., requires the utilization of a particular type of equipment known as sliding shuttering.

These sliding shutterings generally move along a reference line which, in fact, is a slide bar, fixed in a vertical plane, their upward movement being obtained by pushing members, such as jacks.

The union between the jack and the shuttering is usually made by means of a frame which moves with the sliding shuttering.

To prevent the frame-shuttering assembly moving back when a jack is being set, locking means have been provided in some devices which engage with the slide bar as soon as the shuttering has completed its defined course.

In this way, the jack can bear on the locking means with a view to effecting a second locking operation.

However, in this type of known device the locking means are not very efficient in that they are set off with a certain delay with respect to the end of the course of the frame, which causes the shuttering to move backward.

In addition, the device was relatively bulky as the jacks were located outside the slide bars, which greatly complicated the manufacture of the devices concerned.

Finally, an unintended backward movement of the frame supporting the shutterings can vary on different slide bars, which required frequent adjustments by the operator and caused a considerable loss of time.

The object of the invention is to overcome these disadvantages and relates to this end to a device for raising a sliding shuttering for the continuous production of concrete partitions, this device moving along at least one slide bar and comprising a frame fitted to a shuttering, the assembly being movable so that it can be moved by pushing means, the device in addition, comprising locking devices to prevent its unintended backward movement, which device is characterized in that it consists of two cases, coaxial with the slide bar, separated from one another by a jack, also coaxial, of which each of the two parts is respectively integral with the cases, each case comprising locking jaws in its interior which, alternating from one case to the other, engage with the slide bar, the locked case serving as a support point for the case in movement and reciprocally, the pressure of the compressed fluid in the first chamber of the cylinder of the jack is responsible for raising the case joined to the frame supporting the shuttering, while the upward movement of the other box is obtained by the pressure of the compressed fluid in the second chamber of the cylinder concentric with the first, the jack thus being double-acting, a distributor directing the fluid first to one chamber and then to another, which enables an efficient device to be provided and avoid even a slight backward movement of the shuttering.

According to another characteristic feature of the invention, the two cases are substantially identical, each case being constituted by a body of square cross-section in two planes parallel to the head of the case, an assembly of jaw-retaining screws between which are held the locking jaws of which the convex rear face bears on the retaining screws and on the case, while the front face is at a sharp angle effectively opposing any unintended movement of the raising device, these jaws being maintained in the working position by a spiral resting, on the one hand, on the base of the body and, on the other, on a guide washer fitted into the slide bar.

According to another characteristic feature of the invention, the lower case, integral with the case holding the shuttering, is linked to the piston of the jack by screwing, while the cylinder of this same jack is integral by reason of being bolted to the upper case.

The invention also intends to provide a sliding shuttering operating with the aid of a high pressure fluid and a double-acting jack, comprising an automatic leveler and causing an extremely rapid upward movement to be obtained of the order of 15 seconds a timed automatic control and a hydraulic pulse supplied by a simple pump may if necessary be fitted.

It is also possible to operate this sliding shuttering with a hand pump in case of breakdown of the electricity supply and extract the shuttering from the parts already cast in order to stop the work, either because of sundays, holidays, frost or any other reason.

It is also extremely easy to mount the shuttering-case-jack assembly and even to reposition it after stopping casting, simply by operating the control devices and reversing these, enabling the shuttering to descend and the previously stopped work to be put bac level.

It enables concrete partitions to be smoothed and finished carefully with the aid of platforms inside and outside the shuttering, as well as to give a high yield.

A device according to the invention is illustrated, by way of non limitative examples, on the adjoining figures, in which.

Figure 1:
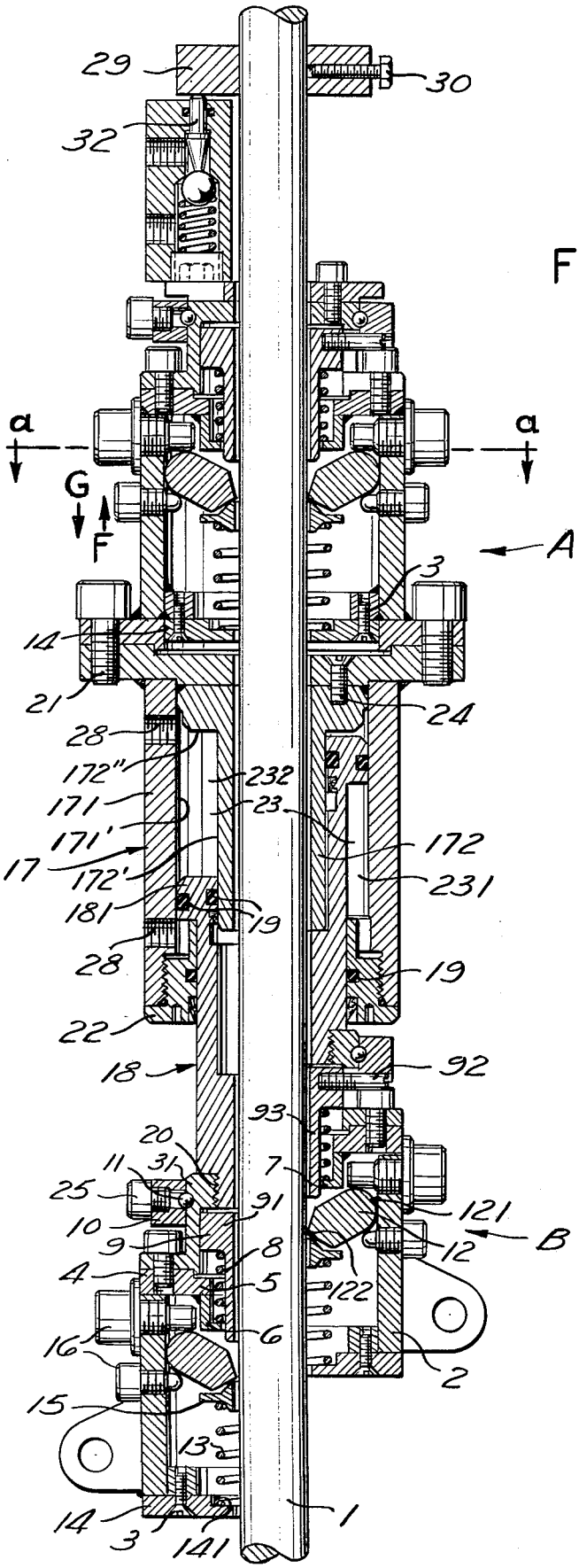
FIG. 1 is an axial section of the device according to the invention.

The two essential objects of the invention are to obtain a device in which the jaws are locked instantaneously, so that the actual course of the shuttering is equal to or substantially equal to its theoretical course, and the operation of the jack is double-acting, thus ensuring a uniform upward movement, without any shuttering dead time.

According to the invention, the device consists of two similar cases A and B, coaxial with the slide bar 1 which is mounted fixed in a vertical plane.

Each case consists of hollowed-out welded body 2, comprising a base 14 joined to the body 2 by the screws 3 and pierced in its center by an opening which allows the rod 1 to pass freely through it.

This body comprises, at its upper part, a case head 4 consisting of a plate 5 hollowed out at its center, into which is welded a metal ring 6 with an annular shoulder 7, projecting into the interior of the ring. This annular shoulder 7 serves as a seating for a spiral spring 8, which surrounds a ring 9 coaxial with the slide bar 1, this ring being controlled by a second ring 10.

A part of the ring 9 partly penetrates the case and comprises a circular shoulder 91 controling the position of the spiral spring 8.

The two rings 9 and 10 allow the jaws 12 to be unlocked. The ring 10, which can turn about the cap 31 of the case thanks to the balls 11, comprises on its lower face two arcuate inclined ramps on which bear two gudgeons 92 integral with the ring 9.

On the case head 4, are positioned the jaws 12 which, in the example under consideration, are four in number, these jaws having the convex rear part 121 and a front part 122 with a arcuate knife edge surface.

Figure 2:
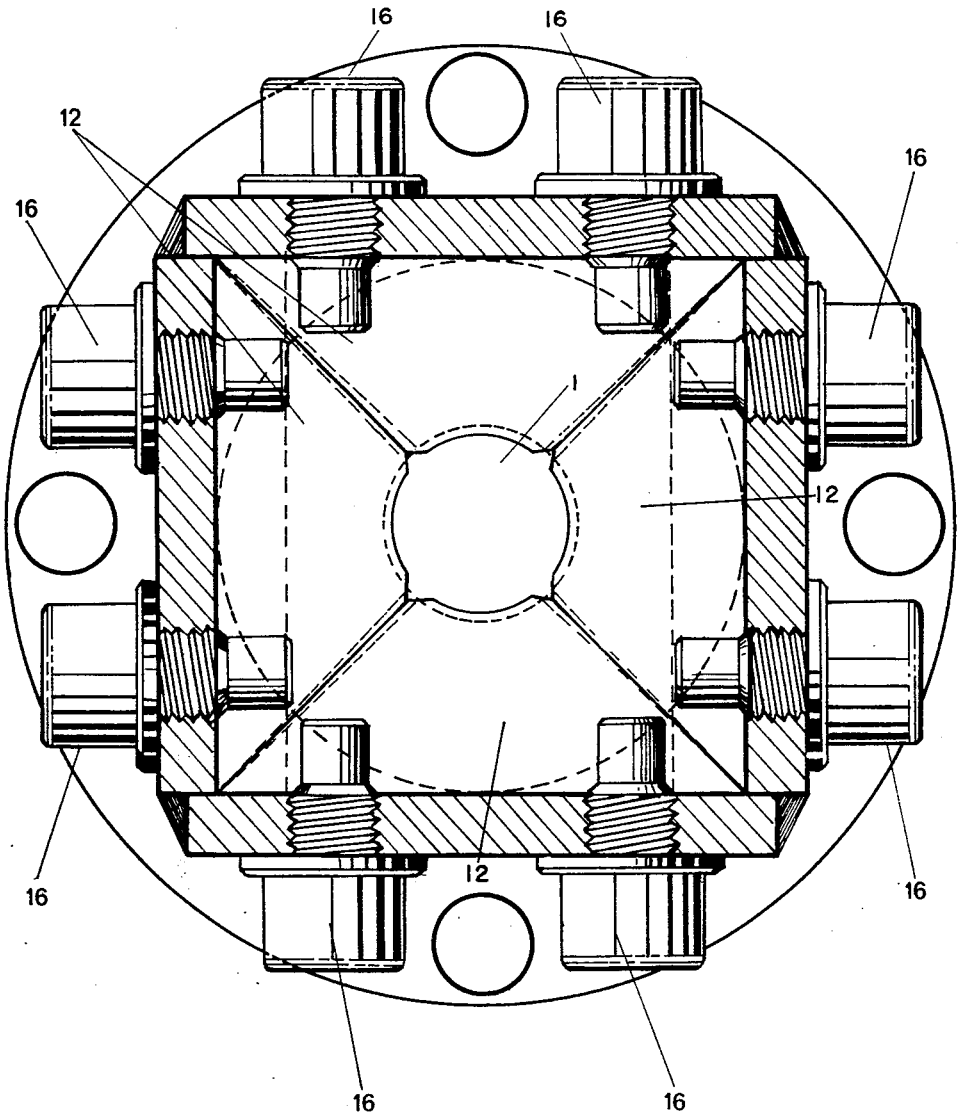
FIG. 2 is a plan view of a section of FIG. 2, along the line *a—a*.

These jaws, as shown in FIG. 2, are positioned around the slide 1 and are simply engaged into the body of the case, where they are maintained in position in their rear part 121 between the high and low retaining screws 16, and in their front part, by a spiral spring 13 resting, on the one hand, on the base 14 of the case inside a bore 141 and, on the other, on a spring guide washer 15.

The two cases A and B are identical and the angle 122 which the jaws are made to describe is such that these retract, to a certain extent, during the upward movement of the raising device, whereas on the other hand, they pinch the slide bar 1 when the raising device initiates a backward movement.

In other words, the jaws allow the raising device to move in the direction of the arrow F but oppose its backward movement in the direction of the arrow G.

The angle given to these jaws is therefore determining, because it is by its eccentricity with respect to the transversal axis of these jaws, that it causes the the jaws to pinch the slide bar and generally lock the raising device.

A jack C is provided between the two cases in order in general to move the shuttering.

This jack C consists of two parts 17 and 18 sliding with respect to one another under airtight conditions thanks to the segments 19, one of the parts of the jack, and in particular the piston 18, being integral with the lower case B, whereas the cylinder 17 is integral with the upper case A.

The piston 18 is connected to the case B by a simple screwing means 20, whereas the cylinder 17 is connected to the case A by means of threaded bolts 21.

The cylinder 17 consists of two parts, the welded body of the jack 171 and the machined piston guide 172, coaxial with the slide bar 1.

In its movement, the piston 18 sweeps out a volume 23 delimited laterally by the interior skirt 172' of the piston guide, the outer skirt 171' of the body of the jack, by the heel 172'' of the piston guide in its upper part, and by the chamber cover 22 in its lower part.

To the body of the jack 171 are fixed the piston guide 172 by its heel 172'' and the screws 24, and the chamber cover 22.

This space 23 is divided into two chambers 231 and 232 by the piston head 181, into the upper and lower faces of which the pressure of the fluid can act alternatively thus making the jack double-acting.

When, for example, silos are being constructed, a certain number of slide bars 1 are distributed on the periphery of the work and of course, also a certain number of raising devices, so that the shuttering is lifted symmetrically at several points distributed angularly.

Figure 5:
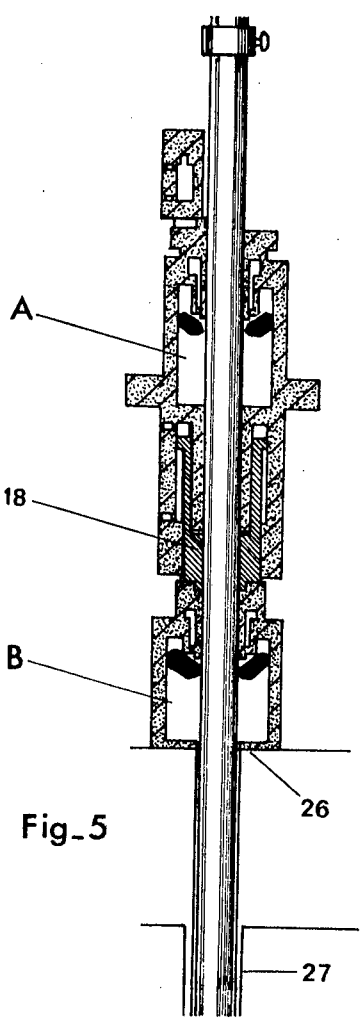
FIGS. 3 to 5 are schematic views illustrating the operating cycle of the device.
Figure 4:
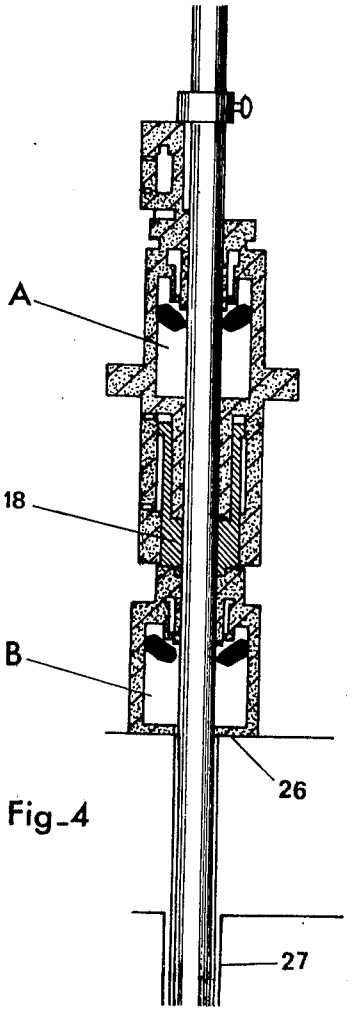
Figure 3:
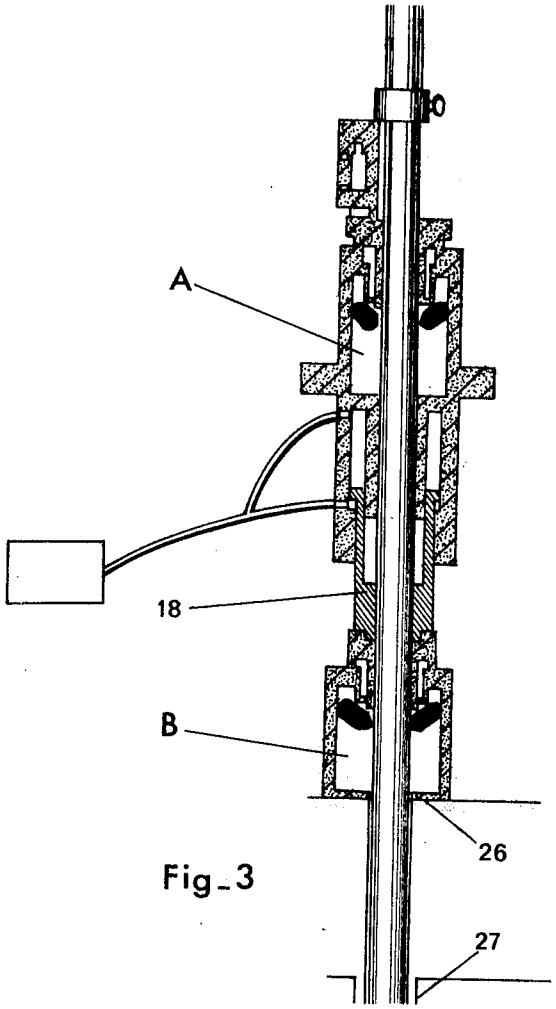

The raising device, as described hereabove, is fixed to a frame 26, which latter supports a part of the shuttering 27 (see FIGS. 3 to 5).

It is therefore necessary that all the raising jacks follow an identical course, if it is desired that the shuttering be level at all points.

The operating device operates as follows (FIG. 1).

Since a cycle is concerned, a start is made with the assumption that the chamber 231 occupies all the space 23, and is filled with a high-pressure fluid, and that the chamber 232 is consequently reduced to its smallest size, the upper face of the piston head 181 practically touching the heel 172'' of the piston guide. The jaws 12 of the case B are pinched into the slide bar 1 and the case B serves as a port point for the case A which has to move. If the pressure in the chamber 231 is released, the force due to the low pressure fluid of the chamber 232 becomes greater that that exerted on the piston by the fluid of the chamber 231.

But as the case B is locked in position by the jaws 12 which are held partially inside the slide and the piston 18 is integral with this case, only the cylinder 17 and the case A with which it is integral can move upward.

The case A can therefore move upward which is made possible since the jaws 12 do not impede this movement.

This cyclic phase is illustrated in FIG. 3 which shows, at low pressure, the case A pushed upward, while the case B is in its bearing position with its jaws 12 pinched into the slide bar 1. This upward movement of the case A corresponds to the first action of the jack, during which the force exerted by the low-pressure fluid raises the part that is is least heavy, namely, the part A.

On the other hand, in the second phase, when the frame and the shuttering has to be raised it is the force exerted by the high-pressure fluid that is the driving means. If the high-pressure fluid is again introduced into the chamber 231 through the orifice 28, the pressure applied beneath the piston head 181 moves the latter upward, carrying with it the case B as well as the frame and the shuttering which are integral of one another.

During this movement, which corresponds to the second action of the jack, the low-pressure fluid of the chamber 232 has been driven out of the jack.

Moreover, during the upward movement of the case B, the case A is locked in position by means of the jaws 12 which oppose its backward movement, following the arrow G.

This second phase is clearly illustrated in FIG. 4 in which it is seen that the piston 18, the case B, the frame 26 and the shuttering 27 have been moved upward, whereas the case A does not move, since it is locked in position by its jaws 12. It is also seen that the low-pressure chamber 232 has its minimum volume and that the jaws of the case B are away from the slide bar 1.

If the hydraulic pressure in the chamber 231 is again released, the device returns to the first operating phase discussed above during which the case B is locked by its jaws and the case A moves by the action of the low-pressure fluid on the cylinder 17.

This new phase is illustrated in FIG. 5 in which it is clearly seen that the jaws 12 of the case B are pinched into the slide bar 1, whereas the jaws 12 of the case A are retracted to enable it to move upward.

As indicated above, the jaws 12 of the cases enable the raising device to move upward, but hold it back when it might move backward.

When, however, it is desired to return the raising device to its low position, use is made of the jaw unlocking device constituted by two rings 9 and 10.

This locking operation is effected by by means of a control member 25, which enables the ring 10 to be rotated, which, in turning, imparts to the ring 9 by means of the gudgeons 92 integral with the latter, a vertical downward movement until its lower end 93 acts on the jaws to make them retract, while compressing the spiral spring 8.

In this position, the jaws are no longer pinched into the slide bar 1 and the raising device can be brought to its low position, it being understood that this unlocking operation takes place on the two cases.

In addition, in order for the various lifting devices always to be at a constant level, a stop ring 29, locked by a nut 30, is placed at a defined height, so as to limit the course of the jack by the cap abutment 32 of the case A against this ring 29.

However, this device is essential only if the pressures are high, for example, above 50 kg/cm$^2$. On the other hand, when the pressures are low, the raising device simply comes up against en abutment.

These rings are, of course, located at the same level on all the slides.

In this way, frequent manual adjustments which operators have to make are avoided.

Of course, the invention is not limited to the example of its embodiment hereinabove described and illustrated and on the basis of which other variants can be envisaged without departing from the scope of the invention.

We claim:

1. In combination, a slide bar and a device for raising sliding shutterings on said slide bar, said sliding shuttering raising device comprising two spaced apart casing members and a jack member interconnecting said casing members, said casing members and said jack member each being coaxial with and movable on said slide bar, said jack member including a cylinder connected to one of said casing members and a piston connected to the other of said casing members, said piston and cylinder defining two separate fluid pressure chambers and said piston and cylinder being mounted for reciprocating movement relative to each other, said casing members each including a set of unidirectional locking jaws and an abutment surface surrounding said slide bar and locking jaws, each set of said locking jaws including a plurality of jaw members circumferentially disposed about said slide bar between said slide bar and said abutment surface, said abutment surface extending solely in the aixal direction and being spaced radially outwardly a predetermined distance from said slide bar, said jaw members each having a radially innermost front surface and a radially outermost rear surface, said jaw members each having a length between said innermost surface and said outermost surface exceeding said predetermined distance, said innermost surface being spaced axially vertically below said outermost surface whereby said jaw members are angularly disposed in the space between said slide bar and said abutment surface, the vertical cross-sectional shape of said innermost surface being a sharp edge adjacent said slide bar arranged to engage said slide bar, said outermost surface being constructed and arranged to butt against said abutment surface, and spring means acting axially upwardly against said jaw members and urging said innermost surface against said slide bar and urging said outermost surface against said abutment surface.

2. The combination defined in claim 1 wherein the vertical cross-sectional shape of said outermost surface is arcuate and convex.

3. The combination defined in claim 2 wherein the lateral cross-sectional shape of said innermost surface is arcuate, and the lateral cross-sectional shape of said outermost surface is a straight line.

4. The combination defined in claim 1 wherein each casing includes an upper retaining element engaging each jaw member and preventing axially upward movement of each jaw member relative to said casing, and a lower retaining element engaging each jaw member and preventing axially downward movement of each jaw member relative to said casing.

5. The combination defined in claim 4 wherein each of said retaining elements is a threaded screw projecting radially inwardly from said abutment surface.

* * * * *

UNITED STATES PATENT AND TRADEMARK OFFICE

CERTIFICATE OF CORRECTION

PATENT NO. : 3,948,483

DATED : April 6, 1976

INVENTOR(S) : Jean Marie De Leaumont

It is certified that error appears in the above-identified patent and that said Letters Patent are hereby corrected as shown below:

On the title page of the patent, after item [21] and before item [52], insert:

[30] Foreign Application Priority Data

January 31, 1974 France.....74 03326

Signed and Sealed this

Twenty-third Day of November 1976

[SEAL]

*Attest:*

RUTH C. MASON
*Attesting Officer*

C. MARSHALL DANN
*Commissioner of Patents and Trademarks*